United States Patent [19]

Aistleitner

[11] 4,009,923

[45] Mar. 1, 1977

[54] CONNECTOR FOR SHIELDED ELECTRIC CABLES

[75] Inventor: Olaf Aistleitner, Munich, Germany

[73] Assignee: Siemens Aktiengesellschaft, Berlin & Munich, Germany

[22] Filed: Nov. 4, 1975

[21] Appl. No.: 628,586

[30] Foreign Application Priority Data

Dec. 23, 1974 Germany ..... 2461282

[52] U.S. Cl. ..... 339/143 R

[51] Int. Cl.[2] ..... H01R 3/06

[58] Field of Search ..... 339/143 R, 143 C, 14 P, 339/136 R, 136 M, 139 R, 139 C

[56] References Cited

UNITED STATES PATENTS

| | | | |
|---|---|---|---|
| 3,643,208 | 2/1972 | Massa | 339/143 R X |
| 3,659,251 | 4/1972 | Fish | 339/143 R |
| 3,761,844 | 9/1973 | Reeder | 339/143 R X |

*Primary Examiner*—Roy Lake
*Assistant Examiner*—E. F. Desmond
*Attorney, Agent, or Firm*—Hill, Gross, Simpson, Van Santen, Steadman, Chiara & Simpson

[57] ABSTRACT

Screens or shields about multi-conductor electric cables are electrically joined simultaneously with the conductors through a plug and socket connection. Each plug and socket has a screening plate contactingly engaged with the cable shield via a cable clamp securing the cable to the plug or socket housing. The two screening plates are electrically connected by usual pins and pin-sockets upon the plug and socket members.

1 Claim, 3 Drawing Figures

CONNECTOR FOR SHIELDED ELECTRIC CABLES

BACKGROUND OF THE INVENTION

1. Field of the Invention

The present invention relates to an arrangement for establishing electrical continuity of a cable shield or screen through a multi-conductor plug and socket arrangement.

2. Prior Art

It is well known in the art to join two cable ends together by a plug and socket connection, using one pin and pin-socket for each electric conductor in the cables. Where the cables are shielded, screened, or sheathed by a conductive sheath enclosing all the electric wires within the cable, a problem is presented to assure electric continuity of the cable screen or shield through the plug and socket connection. One solution in the prior art has been to engage each of the plug and socket in matable halves of a metal box and to establish electrical continuity of the cable screen when the box is assembled about the plug and socket. Another solution has been to connect the cable screens by means of a metal strap assembled in addition to the socket and plug. Both such prior art connections require an additional operation besides the engagement together of the plug and the socket.

SUMMARY OF THE INVENTION

A primary object of the invention is to provide apparatus for establishing electrical continuity of a cable shield or screen through a conventional-type plug and socket, using simple means integral with the plug and socket and not requiring a separate operation or apparatus for connection thereof.

In accordance with the invention, a connector comprises a plug member having a plurality of pins and a socket member having a corresponding plurality of pin-sockets each of which is engageable with a corresponding one of the pins of the plug member. Each of the plug and the socket has an electrically-conductive cable clamp affixed to a housing thereof for electric engagement with a shield about the shielded cable leading thereto. An electrically-conductive screening plate is affixed to and extends along the housing, being at one point in electrical contact with the cable clamp and at another point in connection with at least one of the pins or pin sockets. Thus, the shield of the first cable will be electrically connected to the shield of the second cable by the cable clamp of the plug, the screening plate and a pin connected thereto in the plug, a pin socket of the socket member engaged with the pin, and the screening plate and the cable clamp of the socket member. The connection between the screens or shields of the two cables is readily established or severed by joining or disconnecting the plug and socket members in a usual manner, just as if no screening or shield existed.

DESCRIPTION OF A PREFERRED EMBODIMENT

Figure 1:
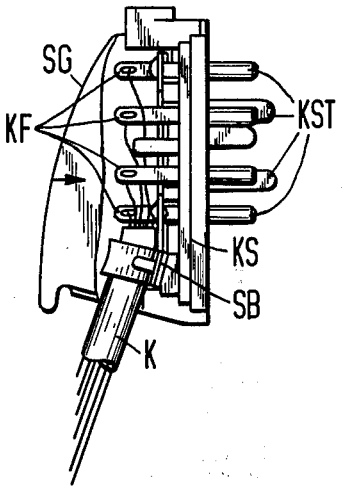
FIG. 1 is a side elevation of an electrical plug incorporating the invention.

In FIG. 1, a generally conventional multi-pin plug is shown, having a housing SG containing an insulating contact base portion KS. Inside the housing SG, atop the contact base KS, contact tags KF are provided. The tags KF are conveniently unitary with contact pins KST extending from the bottom of the plug below the base KS, which orients, separates, and holds the pins KST. The pins KST and tags KF are conveniently distributed over the length of the base KS in parallel rows. At one end of the housing SG, at the end of the rows of tags KF, a cable clamp S is affixed to the housing SG to receive a circumferentially shielded or screened cable K. The clamp S comprises an electrically-conductive material and is sized to closely engage the periphery of the cable K and to engage the conductive shield or screen thereof.

Figure 2:
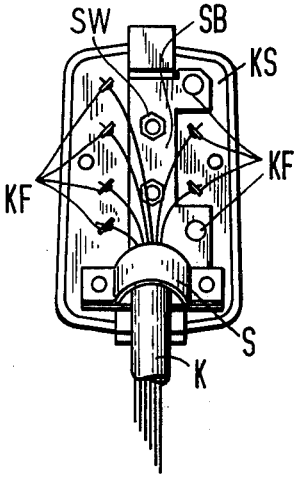
FIG. 2 is a top plan view of the plug of FIG. 1.

In accordance with the invention, a screening plate SB is affixed in the plug housing SG to overlie the contact base KS and to electrically engage the cable clamp S at one end of the housing SG. As shown in FIG. 2, the screening plate SB conveniently lies between the rows of contact tags KF. The screening plate SB is also attached electrically to two spares among the contact tags KF, at the upper and lower right as shown in FIG. 2. Such connections are shown as riveted in FIGS. 1 and 2 but may be soldered or crimped. Contact pins KST extending from the contact base KS are otherwise conventional. The screening plate SB may conveniently be attached to the contact base KS by means of screws SW or another convenient means such as clamps if support from the cable clamp connection and contact tag connections are not sufficient to prevent shifting or loosening of the plate. The connection of the screening plate SB to the cable clamp S is assured to have a low resistance by screwing or riveting the parts together.

Figure 3:
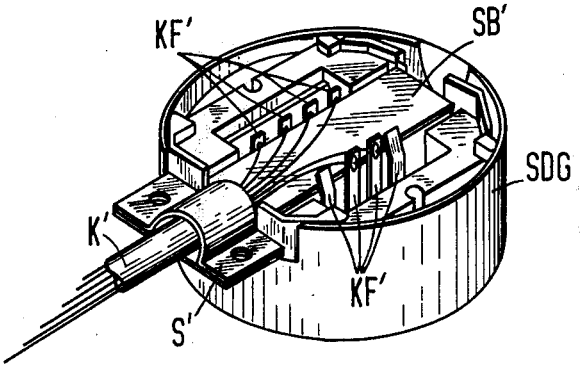
FIG. 3 is a perspective view of a socket member employing the present invention.

FIG. 3 shows a corresponding socket usable with the plug of FIGS. 1 and 2. A housing SDG of the socket has located thereon a plurality of pin-sockets (not shown) corresponding in number, size, and orientation to be engageable with the contact pins KST of the plug, and up-standing contact tags KF′ and a cable clamp S′ affixed therein. A screening plate SB′ is affixed to the socket housing SDG and extends between the row of contact tags KF′, being soldered or crimped for electrical contact with two of the pins KF′. The screening plate SB′ joins electrically to a cable clamp S′ at one end of the housing SDG. When a second sheathed or screened cable K′ corresponding to the cable K in FIGS. 1 and 2 is placed within the clamp S′ and engaged thereby, electrical connection is made between the screening plate SB′ and the shield of the cable K′.

Thus, when the plug of FIGS. 1 or 2 is joined with the socket of FIG. 3, not only the conductor wires within the cables K and K′ are joined to one another but also the sheath, shield, or screen of the cable K is connected electrically to that of the cable K′. Such connection is made by the cable clamp S of the plug, the screening plate SB, the two contact tags KF and their connected pins KST, through the connection of the pins KST with the corresponding pinsockets of the socket member, through the tags KF′ and the screening plate SB′ to the cable clamp S′. The plug and the socket may be connected or disconnected without making separate provision for connection of the cable screens to one another. Thus, freedom of joining and connecting the cables K and K′ is unimpaired.

It will, of course, be appreciated that the particular embodiment of the screening plates SB and SB′ as shown is merely exemplary. It is equally possible to shape the screening plates to be connected to any of the contact tags KF which do not happen to be required for connection of wires within the cable. Although this and various other such minor modifications might be suggested by those versed in the art, it should be understood that I wish to embody within the scope of the patent warranted hereon all such modifications as reasonably and properly come within the scope of my contribution to the art.

I claim as my invention:

1. An electrical connector for removably joining together first and second cables, comprising a plug member and a socket member, the plug member having a plurality of pins and the socket member having a corresponding plurality of sockets engageable with said pins, the pins and sockets extending substantially transversely of said cables, wherein each of said plug and socket members is adapted for use with a shielded cable having a lesser plurality of conductors, by said members each further comprising:

an electrically-conductive cable clamp connectable to a shield on a respective cable; and an electrically-conductive, flat screening plate affixed to and extending along said member outwardly adjacent the respective pins or sockets and having electric contact with said cable clamp and with at least one of said pins and sockets, whereby the cable screens are simultaneously removably joined together at said electrical connector with joining of the conductors of said cables.

* * * * *